US008950148B2

(12) United States Patent
De Boe

(10) Patent No.: US 8,950,148 B2
(45) Date of Patent: Feb. 10, 2015

(54) FLOOR PANEL

(75) Inventor: Lode De Boe, Moorslede (BE)

(73) Assignee: Flooring Industries Limited, SARL

( * ) Notice: Subject to any disclaimer, the term of this patent is extended or adjusted under 35 U.S.C. 154(b) by 0 days.

(21) Appl. No.: 13/265,705

(22) PCT Filed: Apr. 22, 2010

(86) PCT No.: PCT/IB2010/051770

§ 371 (c)(1),
(2), (4) Date: Oct. 21, 2011

(87) PCT Pub. No.: WO2010/122514

PCT Pub. Date: Oct. 28, 2010

(65) Prior Publication Data

US 2012/0042595 A1 Feb. 23, 2012

(30) Foreign Application Priority Data

Apr. 22, 2009 (BE) ..... 2009/0252

(51) Int. Cl.
*E04B 2/00* (2006.01)
*E04F 15/02* (2006.01)

(52) U.S. Cl.
CPC ..... *E04F 15/02* (2013.01); *E04F 2201/0153* (2013.01); *E04F 2201/044* (2013.01); *E04F 2201/0523* (2013.01)
USPC ..... 52/592.1; 52/582.2; 52/309.15

(58) Field of Classification Search
USPC ..... 52/588.1, 582.2, 309.13, 591.3, 282.1, 52/586.1, 591.1, 592.2, 592.1, 309.15; 403/364, 381, 334, 345, 372, 375, 376
See application file for complete search history.

(56) References Cited

U.S. PATENT DOCUMENTS 3,579,941 A * 5/1971 Tibbals ..... 52/384
4,449,346 A * 5/1984 Tremblay ..... 52/509
4,543,765 A * 10/1985 Barrett ..... 52/747.11
5,497,589 A * 3/1996 Porter ..... 52/309.7

(Continued)

FOREIGN PATENT DOCUMENTS

BE 1012086 A3 4/2000
DE 199 63 203 A1 9/2001

(Continued)

OTHER PUBLICATIONS

International Search Report and Written Opinion issued in BE00900252, Jan. 21, 2010, 9 pages.

(Continued)

*Primary Examiner* — James Ference
(74) *Attorney, Agent, or Firm* — Workman Nydegger

(57) ABSTRACT

A floor panel for a floor covering includes a pair of two opposite sides having coupling parts allowing to couple the floor panel to similar floor panels. The coupling parts, in a coupled condition, provide locking in vertical and horizontal directions. The floor panel has a core including two core material parts provided as a sandwich structure between an upper layer and a bottom layer, and respectively extending up to one of the two sides. A locking element is in the form of an insert located at one of the sides of the coupling parts, and is mounted in the core material part. The locking element is of the type which, in the coupled condition of two of such floor panels, effects a locking in a vertical direction. The two core material parts include a different basic material or a basic material with different properties.

12 Claims, 6 Drawing Sheets

(56) References Cited

U.S. PATENT DOCUMENTS

| | | | | |
|---|---|---|---|---|
| 5,502,939 | A * | 4/1996 | Zadok et al. | 52/309.9 |
| 5,661,937 | A * | 9/1997 | Doppler et al. | 52/410 |
| 6,006,486 | A * | 12/1999 | Moriau et al. | 52/589.1 |
| 6,029,416 | A * | 2/2000 | Andersson | 52/592.1 |
| 6,101,778 | A * | 8/2000 | Mårtensson | 52/582.1 |
| 6,182,410 | B1 * | 2/2001 | Pervan | 52/403.1 |
| 6,209,278 | B1 * | 4/2001 | Tychsen | 52/592.4 |
| 6,216,409 | B1 * | 4/2001 | Roy et al. | 52/589.1 |
| 6,260,326 | B1 * | 7/2001 | Muller-Hartburg | 52/601 |
| 6,314,701 | B1 * | 11/2001 | Meyerson | 52/588.1 |
| 6,324,803 | B1 * | 12/2001 | Pervan | 52/403.1 |
| 6,324,809 | B1 * | 12/2001 | Nelson | 52/592.2 |
| 6,345,481 | B1 * | 2/2002 | Nelson | 52/592.2 |
| 6,418,683 | B1 * | 7/2002 | Martensson et al. | 52/282.1 |
| 6,421,970 | B1 * | 7/2002 | Martensson et al. | 52/282.1 |
| 6,446,405 | B1 * | 9/2002 | Pervan | 52/403.1 |
| 6,490,836 | B1 * | 12/2002 | Moriau et al. | 52/589.1 |
| 6,532,709 | B2 * | 3/2003 | Pervan | 52/403.1 |
| 6,588,166 | B2 * | 7/2003 | Martensson et al. | 52/578 |
| 6,601,359 | B2 * | 8/2003 | Olofsson | 52/588.1 |
| 6,606,834 | B2 * | 8/2003 | Martensson et al. | 52/578 |
| 6,766,622 | B1 * | 7/2004 | Thiers | 52/591.3 |
| 7,337,588 | B1 * | 3/2008 | Moebus | 52/592.4 |
| 7,431,979 | B2 * | 10/2008 | Grafenauer | 428/292.4 |
| 7,484,337 | B2 * | 2/2009 | Hecht | 52/578 |
| 7,506,481 | B2 * | 3/2009 | Grafenauer | 52/592.1 |
| 7,550,202 | B2 * | 6/2009 | Pohlmann | 428/403 |
| 7,562,431 | B2 * | 7/2009 | Lewark | 29/451 |
| 7,584,583 | B2 * | 9/2009 | Bergelin et al. | 52/588.1 |
| 7,596,920 | B2 * | 10/2009 | Konstanczak | 52/589.1 |
| 7,617,651 | B2 * | 11/2009 | Grafenauer | 52/592.1 |
| 7,621,092 | B2 * | 11/2009 | Groeke et al. | 52/586.1 |
| 7,641,963 | B2 * | 1/2010 | Grafenauer | 428/212 |
| 7,651,751 | B2 * | 1/2010 | Hasch et al. | 428/50 |
| 7,654,055 | B2 * | 2/2010 | Ricker | 52/592.1 |
| 7,762,035 | B2 * | 7/2010 | Cappelle | 52/588.1 |
| 7,802,415 | B2 * | 9/2010 | Pervan et al. | 52/745.19 |
| 7,827,749 | B2 * | 11/2010 | Groeke et al. | 52/316 |
| 7,854,986 | B2 * | 12/2010 | Oldorff | 428/212 |
| 7,866,115 | B2 * | 1/2011 | Pervan et al. | 52/745.19 |
| 7,897,005 | B2 * | 3/2011 | Knauseder | 156/304.5 |
| 7,908,816 | B2 * | 3/2011 | Grafenauer et al. | 52/586.2 |
| 7,913,473 | B2 * | 3/2011 | Schitter | 52/745.2 |
| 7,926,234 | B2 * | 4/2011 | Pervan et al. | 52/390 |
| 7,930,862 | B2 * | 4/2011 | Bergelin et al. | 52/316 |
| 8,028,486 | B2 * | 10/2011 | Pervan et al. | 52/588.1 |
| 8,037,657 | B2 * | 10/2011 | Sjoberg et al. | 52/592.1 |
| 8,176,698 | B2 * | 5/2012 | Lewark | 52/316 |
| 8,201,600 | B2 * | 6/2012 | Birkett et al. | 144/347 |
| 8,215,078 | B2 * | 7/2012 | Pervan | 52/592.1 |
| 8,245,478 | B2 * | 8/2012 | Bergelin et al. | 52/592.1 |
| 8,257,791 | B2 * | 9/2012 | Grafenauer | 427/258 |
| 8,261,504 | B2 * | 9/2012 | Hakansson | 52/391 |
| 8,293,058 | B2 * | 10/2012 | Pervan et al. | 156/265 |
| 8,323,016 | B2 * | 12/2012 | Jacobsson et al. | 425/374 |
| 8,341,916 | B2 * | 1/2013 | Sjoberg et al. | 52/592.4 |
| 8,359,805 | B2 * | 1/2013 | Pervan et al. | 52/582.1 |
| 8,365,499 | B2 * | 2/2013 | Nilsson et al. | 52/747.1 |
| 2002/0023702 | A1 * | 2/2002 | Kettler | 156/62.2 |
| 2002/0189747 | A1 * | 12/2002 | Steinwender | 156/157 |
| 2003/0024199 | A1 * | 2/2003 | Pervan et al. | 52/589.1 |
| 2003/0024200 | A1 * | 2/2003 | Moriau et al. | 52/592.1 |
| 2003/0024201 | A1 * | 2/2003 | Moriau et al. | 52/592.1 |
| 2003/0029115 | A1 * | 2/2003 | Moriau et al. | 52/592.1 |
| 2003/0029116 | A1 * | 2/2003 | Moriau et al. | 52/592.1 |
| 2003/0029117 | A1 * | 2/2003 | Moriau et al. | 52/592.1 |
| 2003/0079820 | A1 * | 5/2003 | Palsson et al. | 156/91 |
| 2003/0115812 | A1 * | 6/2003 | Pervan | 52/283 |
| 2004/0031225 | A1 * | 2/2004 | Fowler | 52/578 |
| 2004/0035077 | A1 * | 2/2004 | Martensson et al. | 52/578 |
| 2004/0035079 | A1 * | 2/2004 | Evjen | 52/592.1 |
| 2004/0250914 | A1 * | 12/2004 | Olofsson | 144/371 |
| 2006/0064940 | A1 * | 3/2006 | Cappelle | 52/589.1 |
| 2008/0104921 | A1 * | 5/2008 | Pervan et al. | 52/588.1 |
| 2009/0019806 | A1 * | 1/2009 | Muehlebach | 52/588.1 |
| 2009/0217615 | A1 * | 9/2009 | Engstrom | 52/588.1 |

FOREIGN PATENT DOCUMENTS

| | | | |
|---|---|---|---|
| DE | 101 63 435 | C1 | 2/2003 |
| DE | 201 21 836 | U1 | 6/2003 |
| DE | 10 2006 048 471 | A1 | 4/2008 |
| DE | 20 2008 008 597 | U1 | 9/2008 |
| DE | 20 2009 004 530 | U1 | 7/2009 |
| EP | 0 974 713 | A1 | 1/2000 |
| EP | 1 650 375 | A1 | 4/2006 |
| WO | 97/47834 | A1 | 12/1997 |
| WO | 99/66152 | A1 | 12/1999 |
| WO | 02/24421 | A1 | 3/2002 |
| WO | 2007/015669 | A2 | 2/2007 |
| WO | 2007/141605 | A2 | 12/2007 |
| WO | 2008/060232 | A1 | 5/2008 |
| WO | 2008/078181 | A1 | 7/2008 |
| WO | 2009/066153 | A2 | 5/2009 |
| WO | 2010/078822 | A1 | 7/2010 |

OTHER PUBLICATIONS

International Search Report and Written Opinion in corresponding International Application No. PCT/B2010/051770, mailed Oct. 24, 2011.

* cited by examiner

FLOOR PANEL

FIELD OF THE INVENTION

This invention relates to floor panels for forming a floor covering.

More particularly, the invention relates to floor panels of the type which, at the sides thereof, is provided with coupling parts, which allow coupling a plurality of these panels to each other in a purely mechanical manner, wherein by means of these coupling parts a locking is offered in horizontal as well as in vertical direction.

BACKGROUND

It is known that floor panels for forming a floor covering, thus, floor panels which are intended for being provided on an existing supporting floor, can be of different nature. Two important categories of such floor panels are, on the one hand, the so-called laminate floor panels and, on the other hand, the floor panels constructed as composed parquet panels, which latter also are called "engineered wood" panels.

Mostly, laminate floor panels, for the major part of their thickness, consist of a substrate of a one-piece wood fiberboard, more particularly MDF (Medium Density Fiberboard) or HDF (High Density Fiberboard). On the substrate then a top layer is provided, which then either is formed of one or more sheets impregnated with resin, or is formed of a print, whether or not combined with still other layers. When the one or more sheets impregnated with resin are pressed directly on the substrate, this is called Direct Pressure Laminate (DPL). When first a number of impregnated sheets are pressed together and the obtained whole then is attached to a substrate, this is called High Pressure Laminate (HPL). On the underside, a backing layer can be applied, which mostly is intended for offering a balancing effect in order to provide a warping of the floor panels.

Composed parquet panels usually comprise at least a substrate, a wood layer attached thereto and a wood-based backing layer on the underside of the substrate. The wood layer situated at the upper side functions as a top and decorative layer and mostly is fabricated of hardwood. It can be treated further at its upper side, for example, in order to exert an influence on the appearance thereof and/or to improve the surface quality thereof, for example, by means of coloring, applying a wear-resistant and water-tight transparent lacquer, and so on. The wood-based backing layer mostly consists of a one-piece thin layer of a cheap and mostly soft wood species.

Traditionally, the substrate of a composed parquet panel is composed of a plurality of crosswise-directed laths of wood. In oblong panels, it is also know to replace the laths at the short sides by strips of another material, such as HDF (High Density Fiberboard) or multiplex, in order to increase the strength at these edges. Examples thereof are described in DE 101 63 435 and WO 2007/141605. Also, embodiments of composed parquet panels are known, wherein the entire substrate is replaced by a single continuous wood fiberboard, for example, as described in DE 201 21 836.

Possibly, also other layers, whether or not consisting of wood, may be integrated in such composed parquet panel.

Further, also other floor panels are known which do not fall directly in said two categories, which mostly differ from said categories in that particular top layers are applied on the substrate, such as veneer, cork, vinyl, linoleum, stone, carpet and the like. Thus, the substrate then mostly consists of a single board of MDF (Medium Density Fiberboard) or HDF (High Density Fiberboard).

For information, it is noted that, as commonly known, MDF and HDF consist of wood fibers which, together with a binding agent, are pressed in board shape under the influence of heat and pressure. The production is performed by compressing, in a known manner, a mat of resin-treated fibers until a certain density is reached, wherein the resin is cured such that a bond between the fibers is created. Depending on the degree with which the compression is performed, a final board having a lower or higher density is obtained. The density is the value obtained by taking 1 cubic meter of manufactured board material and determining the weight thereof and then expressing this in kg/cubic meter. When mentioning density herein, then this relates to the average density, in consideration of the fact that the density has a varying density gradient across the board. As a product is concerned which is obtained by compression, the density at the exterior sides of the board is higher than in the middle, and such density gradually decreases from the exterior towards the inside.

Although the term MDF sometimes is applied as a broader term for all wood fiberboard which is realized according to the aforementioned principle, in reality indeed there is a difference between MDF and HDF, wherein it is clear that HDF is a board of higher density than MDF. In the literature, sometimes different density values are given for the limits between MDF and HDF are given, however, in general it may be assumed that this is situated at 800 kg/cubic meter, which indeed corresponds to the usual standards in this respect. Specifically for the description and claims following below applies that by MDF, a fiberboard is understood having a density of less than 800 kg/cubic meter, whereas by HDF, a fiberboard is understood having a density, thus, an average density, of at least 800 kg/cubic meter. In practice, HDF mostly has a density of about 850 kg/cubic meter. Fiberboard below 600 kg/cubic meter is called LDF (Low Density Fiberboard).

It is clear that MDF is a more economic product than HDF, considering that for the same board thickness less basic material, thus, in particular wood fibers, is applied. Moreover, during production the fiber mat must be compressed less forcefully, which requires less energy during production.

In the past, it was common to provide floor panels at their edges with a simple tongue and groove and, when being installed, they were glued into each other at their tongue and groove connection. However, since the second half of the nineties, this manner of connecting is almost completely replaced by the use of purely mechanical couplings with coupling parts which, in the coupled condition of two of such floor panels, provide for a coupling in vertical as well as in horizontal direction. It is clear that the integration of coupling parts, which provide a horizontal as well as a vertical locking, in the edges of the floor panels requires that these coupling parts must show sufficient strength, wherein the strength of the material itself, in which the coupling parts are realized, of course plays an important role. Indeed, it is known that such floor panels can expand and shrink under the influence of temperature and moisture. In particular when shrinking, the floor panels of the mostly floatingly installed floor covering are put under a heavy load, for example, when heavy furniture is placed on such floor covering at opposite sides, which furniture, when the floor covering shrinks, actually has to be carried along. Thus, it are in particular those parts which must provide a horizontal locking, which have to be able to withstand large forces. It is also known that in oblong floor panels, the coupling parts at the short sides mostly have to absorb larger forces per length unit than the coupling parts at the long sides.

It is also known that wood fiberboard in general, and more particularly MDF and HDF, is an anisotropic material, wherein tearing may occur very easily in planes parallel to the surface of the board. Thus, with coupling parts performed in such material, care must be taken that certain parts thereof are not damaged during use, for example, by tearing, tearing off, breaking off or the like, which, of course, may result in less good locking or even may mean that there is no more locking at all. Thus, it is also known to reinforce coupling parts of wood fiber material by impregnating the wood fiberboard and/or the surface with a reinforcing agent, such as polyurethane, or providing such agent herein in another manner. A number of examples where modifications are performed in wood fiberboard on the location where a coupling part must be realized, or a coupling part is realized already, are known, amongst others, from WO 02/24421, DE 199 63 203, FIG. 24e or WO 2008/060232. Sometimes, such modifications also are performed in order to realize a seal against moisture penetration at the surface of coupling parts formed in wood fiberboard, for example, as known from WO 2008/078181.

SUMMARY

The present invention relates to floor panels, amongst others, of the aforementioned two categories, which are composed such that the choice of certain material parts of such floor panels becomes less dependent or even independent of the strength required for the coupling parts. This allows applying less expensive materials for these material parts or optimizing those material parts in function of certain other requirements.

By making, according to a number of embodiments of the invention, very specific material combinations and/or applying a reinforcing agent only on certain sides of floor panels, it is possible to realize such floor panel in a particularly economic manner, whereas this has little or no influence on the strength of the coupling parts, at least not at the sides where a large strength is required.

Another aim of the invention is the realization of floor panels having coupling parts which are additionally reinforced in a simple manner.

In order to realize one or more of said aims, a floor panel according to the invention will meet the herein below described first aspect, second aspect or third aspect. The first aspect relates to a floor panel having a core of a wood fiberboard, wherein coupling parts are provided at the sides of the floor panel and wherein at well-defined sides, purposefully a reinforcing agent is present on the coupling parts. The second aspect aims at the use of wood fiberboard in a floor panel having a density with a value situated within a specific range, in combination with the application of a reinforcing agent at the coupling parts. The third aspect is connected to a composed parquet panel, with a very specific combination of materials for the core or the substrate of the panel.

According to the first aspect, the invention relates to a floor panel for forming a floor covering, wherein this floor panel is rectangular and oblong and comprises one pair of opposite short sides and one pair of opposite long sides; wherein this floor panel, at both pairs of opposite sides, comprises coupling parts allowing to couple the floor panel to similar floor panels; wherein these coupling parts, in coupled condition, provide a locking in vertical as well as in horizontal direction; wherein this floor panel has a core which consists of a wood fiberboard formed of wood fibers which are bonded together by means of a binding agent; wherein this wood fiberboard extends up to the sides of the floor panel; and wherein at least the coupling part of at least one of the short sides is at least partially formed from the wood fiberboard; with the characteristic that said coupling part of said short side is provided with a reinforcing agent provided at the location of the wood fibers, whereas the coupling parts at the long sides, at least over the major part of their length, are free from such reinforcing agent, or this agent is present at these long sides to a lesser extent. By "present to a lesser extent", it is meant that the average amount of reinforcing product applied per length unit is lower than at said short side.

Due to the fact that at the short sides, at least at one of the coupling parts thereof, a reinforcing agent is applied, whereas at the long sides, it is applied to a lesser extent or preferably is not applied, a local reinforcement is provided on the most crucial location, whereas the production cost on the short sides remains limited.

Preferably, the reinforcing agent provides at least for a reinforcement of the coupling parts, which is such that a higher strength is obtained in the coupling parts against damage resulting from horizontally active pulling apart-forces of coupled floor panels.

According to a preferred embodiment, said wood fiberboard consists of MDF (Medium Density Fiberboard) and thus has a density of less than 800 kg/cubic meter and still better of less than 775 kg/cubic meter. By applying MDF, on the one hand, and, on the other hand, applying reinforcing agent at the coupling parts where necessary, the advantage is obtained that the floor panel can be realized in a less expensive manner, whereas still coupling parts are maintained having a strength comparable to similar coupling parts which were made in the usual HDF.

Preferably, the coupling parts at both short sides are performed in wood fiberboard present there, and these coupling parts, at both short sides, are provided with an amount of reinforcing agent provided at the location of the wood fibers. In this manner, a maximum strength at the short sides is ensured.

According to a second independent aspect, the invention relates to a floor panel for forming a floor covering, wherein this floor panel is rectangular, either oblong or square, and comprises two pairs of opposite sides; wherein this floor panel, at both pairs of opposite sides, comprises coupling parts allowing to couple the floor panel to similar floor panels; wherein these coupling parts, in coupled condition, provide a locking in vertical as well as in horizontal direction; wherein the core of this floor panel, at least at one side of the floor panel, consists of a wood fiberboard formed of wood fibers which are bonded together by means of a binding agent; and wherein the coupling part at said at least one side is at least partially formed in the wood fiberboard itself; with the characteristic that said wood fiberboard in which the coupling part is formed consists of wood fiberboard having an average density of less than 825 kg/cubic meter and that this wood fiberboard, at the location of the coupling part, is provided with a reinforcing agent applied via impregnation. Herein, the wood fiberboard preferably is of the MDF or HDF type, wherein in the case of HDF, then only HDF of the lower density range, namely, 800 to 825 kg/cubic meter, comes into consideration for the second aspect.

In the classical known embodiments of coupling parts performed in wood fiberboard, in floor panels always HDF is applied having a density of approximately 850 kg/cubic meter. By now applying, according to the invention, a reinforcing agent and further combining this with wood fiberboard of a lower density, it is clear that less expensive floor panels can be realized, while still ensuring strong coupling parts.

According to a preferred embodiment of the second aspect of the invention, the density of the wood fiberboard is situated between 700 and 825 kg/cubic meter. Densities below this upper limit guarantee a less expensive production, whereas densities above the lower limit, in combination with the reinforcing agent, guarantee sufficient strength of the coupling parts.

Still better, for the wood fiberboard concerned, material is applied having a density lower than 800 kg/cubic meter and the wood fiberboard thus consists of MDF. Still better, MDF is applied having a density of less than 775 kg/cubic meter, and still better of less than 750 kg/cubic meter, whether or not in combination with said lower limit of 700 kg/cubic meter.

In a particular embodiment, wherein a good compromise is obtained between strength originating from the wood fiber material itself and strength provided via the reinforcing agent, a lower limit of at least 725 kg/cubic meter shall be applied, such in combination with one of said upper limits.

Also in the case of a floor panel according to the second aspect of the invention, this preferably is characterized in that the reinforcing agent at least provides for a reinforcement of the coupling parts which is such that a higher strength is obtained in the coupling parts against damage resulting from horizontally active pulling apart-forces of coupled floor panels.

As described herein below, the floor panels of said first as well as of said second aspect, according to various preferred embodiments, can show various additional characteristics, which, inasmuch as they are not contradictory, also can be combined with each other.

According to a first preferred embodiment, such floor panel further is characterized in that also at the long sides of the floor panel, coupling parts formed in one piece in the wood fiberboard are present, however, that these coupling parts situated at the long sides are completely free from said reinforcing agent, possibly with the exception of the extremities of the long sides. It is known that the coupling parts at the long sides normally must absorb less forces per length unit. By applying, according to the invention, the reinforcing agent only selectively at the short sides, it is clear that the amount of such agent to be applied remains limited. However, it is not excluded that at the extremities of the long sides a small amount of the reinforcing agent is present in that, when providing such agent at the short sides, at the extremities thereof, also a small amount thereof gets on one or more coupling parts of the long sides.

According to a preferred embodiment, the reinforcing agent is an agent which is provided in the surface of the coupling parts by impregnating.

The reinforcing agent can consist of any product which can be taken up between the fibers of a wood fiberboard and increases the adherence among the fibers, such by solidifying in between.

More particularly, it is preferred that the reinforcing agent is polyurethane, or an agent on the basis of polyurethane.

According to still another preferred embodiment, such floor panel of the first or second aspect further is characterized in that the coupling parts, at least at one of said sides where a reinforcing agent is provided, comprise a groove which in downward direction is limited by a lower lip, wherein at the lower lip also a locking part is present, which is intended for forming, in coupled condition with a similar panel, a locking in horizontal direction, wherein the reinforcing agent is provided on at least one of the following locations of the coupling part concerned:

at the laterally deepest-situated side of the groove;

at the locking part, for preventing that it is torn off;

at the transition zone between the innermost point of the groove and the upper side of the lower lip; this latter is particularly useful in the case of a lower lip which laterally extends farther than the upper lip, as this, when installing the floor panels, sometimes inadvertently is pressed downward like a lever, as a consequence of which the fiber material may split;

at two or more of the herein above-mentioned locations, whether or not in a continuous manner.

According to still another preferred embodiment, such floor panel of the first or second aspect further is characterized in that the coupling parts, at least at one of said sides where a reinforcing agent is provided, comprise a tongue, with, at the underside thereof, a locking part which is intended for forming, in coupled condition with a similar panel, a locking in horizontal direction, wherein the reinforcing agent is provided at least at the height of the locking part.

According to still another preferred characteristic, the reinforcing agent is applied only at a distance below the edge of the decorative surface of the floor panel and thus starts only at a distance below the upper edge of the floor panel. Hereby, the advantage is obtained that the risk that the decorative side is smeared with said agent, is low, and that moreover it is possible to work less accurately. As no accurate finishing is required, in other words, as the border of the treated zone does not have to be very accurate, production techniques can be applied which allow a high passage speed, such that the usual production speed can be maintained. The fact that it is not necessary to work accurately, also allows that an excess of the agent can be applied, such that a good impregnation can be obtained.

The amount of reinforcement agent to be applied can be determined by tests. Herein, different parameters can be taken into account, such as the desired strength to be obtained, the size of the zone to be treated, the passage speed during application, the viscosity of the reinforcing agent and so on.

The invention, as described herein above, is particularly useful with laminate floor panels substantially consisting of a core or substrate of a one-piece wood fiberboard; a top layer, which either is formed of one or more resin-impregnated sheets which are attached to the wood fiberboard, or is formed of a print, whether or not also combined with other layers; and possibly a backing layer on the underside of the core or the substrate.

According to a third independent aspect, the invention relates to a floor panel for forming a floor covering, wherein the floor panel is constructed as a composed parquet panel, which comprises at least a substrate, a wood layer attached thereon and a preferably wood-based backing layer at the underside of the substrate; wherein this floor panel is rectangular, either oblong or square, and thus comprises two pairs of opposite sides; wherein the floor panel, at both pairs of opposite sides, comprises coupling parts allowing to couple the floor panel on all four sides to similar floor panels; wherein these coupling parts, in coupled condition, provide a locking in vertical as well as in horizontal direction; with the characteristic that said substrate is at least composed of one or more board-shaped material parts and a strip-shaped material part provided at least at one edge, wherein at least one of said coupling parts is realized in the strip-shaped material part and this strip-shaped material part, in respect to material composition, is made different from one or more of said board-shaped material parts.

As for the substrate, use is made of board-shaped material parts instead of the usually applied laths, the advantage is created that the risk of deformations occurring in the upper surface of the floor panel becomes lower, which in its turn offers the advantage that a wooden top layer of a smaller thickness can be applied, which may result in a considerable cost economization, considering that the wood layer situated on top forms the most expensive component. It is known, thus, that in the known embodiments, in which the substrate is composed of wooden laths, the upper surface of the wood layer glued thereon sometimes is uneven, more particularly is corrugated. These unevennesses apparently are the result of irregularities, which continue from the substrate up into the upper surface and which are the result of the fact that a large number of narrow laths are applied. This is probably the result of the fact the laths, in view of their small width, are not always well-oriented in the plane of the floor panel and/or of the fact that the laths show mutual tolerance differences and/or of the fact that there are differences in the hardness of the wood of the laths, which, when pressing during gluing, may result in different thicknesses. In order to exclude this effect in floor panels where the substrate consists of such laths, or to keep it at least within acceptable limits, the top layer usually will be performed with a thickness of minimum 2.5 mm.

By now using, in the floor panel according to the invention, board-shaped material parts instead of the classic laths, a thinner top layer or thus wood layer can be used. In a preferred embodiment, this thus has a thickness of less than 2.5 mm and still better of less than 2.2 mm. In the most preferred embodiment, it shall have a thickness in the order of magnitude of 2 mm.

By applying at the edges strip-shaped material parts which, in respect to material composition, are made different from one or more of said board-shaped material parts, a cost optimization can be performed without reducing the quality of the floor panel. For the material of the strip-shaped material parts, then a material can be chosen which provides good properties in respect to the requirements the coupling parts have to meet, whereas for the board-shaped material part, the board-shaped material parts, respectively, a material can be chosen which must meet less stringent criteria.

According to the invention, the herein above-mentioned term "different material composition" has to be interpreted in a broad manner. Herein, this may relate to materials which as such consist of a different basic material; however, it may also concern materials which are manufactured from the same basic materials, however, wherein the material composition exclusively differs in that a different density is applied. It is clear that in the last case, this relates to a clearly desired, created density difference and not a difference solely being the result of tolerance differences occurring during the production of a material. A "different material composition" may also consist in that originally it is started from entirely the same material, however, afterwards a difference is created by subjecting the material to a treatment for one of the applications, either for the board-shaped material part or for the strip-shaped material part. An example of such treatment may consist in an impregnation which aims at imparting improved properties to the material concerned.

For example, the one or more board-shaped material parts as well as the one or more strip-shaped material parts can be realized from one and the same wood fiberboard, for example, MDF, whereas exclusively the one or more strip-shaped material parts are impregnated with a reinforcing agent, such as polyurethane. In this manner, the material costs for the substrate are lower than in the case that HDF is applied for all component parts, whereas at the location of the strip-shaped material parts thanks to the impregnation still a good material strength is maintained, which is of importance for the coupling parts to be realized therein.

It is clear that generally, it is preferred that each respective strip-shaped material part consists of a material which, as a result of a "difference in material composition", as defined herein above, is stronger than the material of which the board-shaped material part consists, the board-shaped material parts consist, respectively. In this manner, a more light-weight and mostly less expensive material can be applied for the one or more board-shaped material parts, whereas for the strip-shaped material parts, use can be made of a material having a stronger composition, which then mostly also is more expensive.

The floor panel of the third aspect further preferably is characterized in that said board-shaped material part, or, in case that more than one board-shaped material part is applied, at least one of these board-shaped material parts and preferably each board-shaped material part, in the case of a square floor panel, shows at least dimensions which are larger than 20×20 cm, and in the case of an oblong floor panel, at least in the direction extending parallel to the longitudinal direction of the floor panel, has a length of more than 20 cm and still better of more than 30 cm. These dimensions ensure that the disadvantageous effects, which, as aforementioned, may arise when using a substrate which is composed of narrow laths, are excluded or at least minimized.

With oblong floor panels, which are made in accordance with the third aspect of the invention, it is preferred that at both short sides a strip-shaped material part, as aforementioned, is present, in which then the pertaining coupling parts are performed. In this manner, it is guaranteed that both coupling parts can be optimized in respect to strength, independent from the material choice for the one or more board-shaped material parts.

With oblong floor panels, which are made in accordance with the third aspect of the invention, it is also preferred that the board-shaped material part, or in case that more than one board-shaped material part is applied, at least one and preferably each of these board-shaped material parts, extends in the crosswise direction of the floor panel in one piece over the entire width of the floor panel.

According to a particular embodiment of floor panels of the third aspect, those are provided on all four sides with a strip-shaped material part, as aforementioned, in which the respective coupling parts are realized. This embodiment allows realizing coupling parts at all four sides, which are independent from the material of which the board-shaped material parts are consisting. Also, for the one or more board-shaped material parts, then use can be made of materials which as such are not suitable for performing coupling parts therein, such as hollow boards, boards in which cavities are provided, or boards consisting of a supple material. An example is honeycomb board of cardboard or any other material.

In the most preferred embodiment, the substrate comprises a single continuous board-shaped material part which extends over the entire panel, with the exception of the location or locations where a strip-shaped material part, as aforementioned, is present. The use of a single continuous board-shaped material part contributes to a better stability.

In a practical embodiment, the aforementioned one or more strip-shaped material parts are made in HDF (High Density Fiberboard), as such material has a good density for forming coupling parts therein.

In the most preferred embodiment, the floor panels according to the third aspect show the characteristic that said board-shaped material part, each of said board-shaped material parts, respectively, as well as the one or more strip-shaped material parts, are made of wood fiberboard, wherein for one or more and preferably all board-shaped material parts wood fiberboard of a lower density is applied than for the strip-shaped material part, the strip-shaped material parts, respectively. More particularly, it is preferred that the one or more board-shaped material parts consist of MDF (Medium Density Fiberboard) and the strip-shaped material parts consist of HDF (High Density Fiberboard). In this manner, for the one or more board-shaped material parts, use can be made of wood fiberboard of a lower quality, such as MDF, which is produced and available at many places in the world, whereas for the strip-shaped material parts qualitatively better wood fiber board, such as HDF, can be applied. Such qualitatively better wood fiber board is not everywhere available and then must be supplied from further away. As this qualitatively better fiberboard is required exclusively for the strip-shaped material parts, the required amount thereof and thus the transport costs for supplying them, however, remains low.

According to an alternative, said strip-shaped material parts consist of rubberwood.

According to a particular embodiment of the third aspect, the board-shaped material parts consist of elements chosen from the following series: honeycomb board; softboard fiberboard; LDF (Low Density Fiberboard); particle board, either on the basis of wood or on the basis of flax; or cardboard. The honeycomb board can consist of any material, for example, also of metal, for example, thin-walled aluminum, for example, obtained by extrusion.

The use of such honeycomb board in a floor panel also is advantageous in embodiments which meet the characteristics of the third aspect, however, wherein the coupling parts at the respective sides of the floor panel are of any type, thus, for example, consist of a normal tongue and groove. Herein, thus a particular deviating embodiment of the third aspect is concerned.

It is noted that in this description, the term "strip-shaped material part" substantially is intended for stating that a material part is concerned which is situated at the edge or side of the floor panel and moreover has to be interpreted in a broad sense. Preferably, such strip-shaped material part has a length, measured along the edge at which it is provided, which is larger than the width thereof, measured in the plane of the floor panel and perpendicular to the respective edge. However, this is not mandatory, and in certain applications said width can even be larger than said length. Also, a strip-shaped material part can be made wider than a board-shaped material part 32A.

Preferably, each strip-shaped material part indeed extends over the entire height of the substrate in order to allow an easy gluing between the top layer, more particularly said wood layer, and the backing layer. More particularly, the strip-shaped and board-shaped material parts all are of equal thickness.

According to a fourth independent aspect, the invention relates to a floor panel for forming a floor covering, which comprises at least one pair of two opposite sides; wherein this floor panel, at this pair of opposite sides, comprises coupling parts allowing to couple the floor panel to similar floor panels; wherein these coupling parts, in coupled condition, provide a locking in vertical as well as in horizontal direction; wherein this floor panel has a core which consists of at least two core material parts, which are provided as a sandwich structure between an upper layer and a bottom layer, and which respectively extend up to one of said two sides; wherein the coupling parts, at least at one of said sides, comprise a locking element in the form of an insert, which is mounted in the core material part present there, which locking element is of the type which, in the coupled condition of two of such floor panels, effects a locking in vertical direction; characterized in that said two core material parts consist of a different basic material or a basic material with different properties. It is clear that herein by the last-mentioned expression "or", also "and/or" is intended.

It is noted that according to the fourth aspect, by "basic material" the material is understood of which the actual body of such core material part is consisting. By a "different basic material", it must be understood that this may concern materials of a different type, such as, for example, wood versus synthetic material, or solid wood versus a wood composite, however, also may concern materials of a same type, such as, for example, core material parts of two different wood species. Contrary thereto, core material parts consisting of the same material, wherein one of them shows a material alteration exclusively locally due to a surface treatment, for example, impregnation, according to the fourth aspect can not be considered as being of a "different basic material" or being of a "basic material having different properties".

By realizing, according to this fourth aspect, the aforementioned two core material parts, which are situated at the extremities of the floor panel, from a different basic material, the manufacturer is offered the technical possibility of performing an optimization of the obtained product, either with the aim of realizing a more economical or thus less expensive floor panel, or with the aim of offering a floor panel with better technical properties, or in order to meet both of these aims. The material of the two core material parts situated at the aforementioned sides then indeed can be chosen independently from each other, in function of the respective technical requirements, by which in particular the technical requirements are intended of the coupling parts present at the respective sides. When there are stringent requirements at only one side for the material applied, for example, from the point of view of the required technical properties for this material, whereas the requirements are less stringent at the other side, the possibility is created to work at this last-mentioned side with another and less expensive material.

In the case of floor panels which are rectangular and oblong and thus have one pair of opposite short sides and one pair of opposite long sides, it is preferred that said two core material parts are situated at the short sides. It is so that the technical requirements for the coupling parts of the short sides mostly are higher than the technical requirements for the coupling parts of the long sides. The qualitatively better and mostly also more expensive basic materials thus preferably are applied at the short sides. By now moreover applying at both short sides mutually different basic materials for the core material parts, the use of the mostly more expensive basic material can be limited to a strict minimum.

Preferably, a locking element is used which as such exclusively provides for a vertical locking, whereas all remaining parts which provide a locking, thus, substantially in horizontal direction, are realized substantially in one piece from said core material parts. The use of such locking elements as such is known, for example, from WO 2009/066153, DE 202009004530 U1, EP 1.650.375 and WO 2007/015669. Such locking element has the advantage that it can be made quite compact, considering that it substantially has to provide only one locking function, namely, preventing that one panel can come loose vertically from the other from the coupled condition, and the cost price of the locking element remains restricted. In combination with the main idea of the fourth aspect, this offers the advantage that this contributes to an optimization which combines a strong connection by means of said coupling parts with an economically advantageous panel.

More particularly, it is preferred that said locking element consists of a locking strip, which is provided in a recess in the core material part concerned, for example, a locking strip such as known from said WO 2009/066153.

The invention according to the fourth aspect also shows its advantages with floor panels wherein said coupling parts are of the type allowing that two of such floor panels can be coupled to each other by means of a downward movement of one panel in respect to the other, and more particularly with such floor panels in which the locking strip, seen in cross-section, consists at least of an attachment portion and a blocking portion which is movable in respect to the attachment portion and which can cooperate with a locking edge at another panel to be coupled. An example thereof is known from said WO 2009/066153. It is so that in particular with this type of coupling parts the choice of said basic material, at least for one of the sides, is of huge importance in order to be able to realize a stable coupling and/or accurate coupling parts in this manner. By combining this fact with the main idea of the fourth aspect, the manufacturer, amongst others, obtains the advantage that he can employ a durable and consequently mostly also more expensive material at the side concerned, whereas, from an economical point of view, another material is employed at the other side.

It is noted that said "downward movement" has to be interpreted in a broad sense and, amongst others, may relate to a movement wherein two floor panels are joined together by means of a mutual displacement, while remaining parallel at their edges, as well as may also relate to a so-called "fold-down" movement, wherein the floor panels are joined together at the sides concerned by a downward movement, as a consequence of the fact that one of the floor panels, at a side standing at a right angle thereto, is connected to, for example, the floor panels of a preceding row by means of a turning movement. Such fold-down principle is represented, for example, in FIG. 25 of WO 2009/066153.

It is clear that the fourth aspect is intended in particular for floor panels, which are constructed as a composed parquet panel, of the type which consists at least of a core with two or more core material parts, a wooden upper layer and a bottom layer.

In a practical embodiment of floor panels of the fourth aspect, said core shall be composed at least of the aforementioned two core material parts situated at said sides, as well as of one or more intermediate core material parts, wherein the core material parts situated at said sides are made as strip-shaped material parts. It is also preferred that also the intermediate core material parts also are performed as strip-shaped material parts.

It is clear that the fourth aspect of the invention can be realized in various manners. According to one of the possibilities, one of both core material parts situated at said two sides consists of a same material as the intermediate core material parts. In this manner, at only one side a core material part must be provided, which, in respect to the basic material applied, deviates from all other core material parts. This offers the advantage that when composing the core, only on one side a special core material part must be taken into account, which facilitates the sorting operation for bringing the respective core material parts together. In a large number of applications, this also offers the advantage that for the intermediate core material parts as well as for the core material part situated at one side, simply similar parts of the same inexpensive material, for example a cheap wood species, can be applied.

According to still another possibility, both the core material parts situated at said opposite sides are realized from basic materials, which differ from the basic material of which the intermediate core material parts are consisting. This possibility in its turn then offers the advantage that the core material parts situated at the respective sides, in respect to the basic material from which they are made, can be optimized individually in function of the requirements of the coupling part to be formed therein, whereas also the intermediate core material parts can be optimized individually in respect to the basic material applied.

In a practical embodiment of the fourth aspect, only one of the core material parts situated at the aforementioned sides is provided with a locking element mounted therein, and the core material part, which comprises the locking element, consists of wood fiberboard, more particularly MDF (Medium Density Fiberboard) or HDF (High Density Fiberboard). The use of such wood fiberboard allows very precise profile application, with smooth surfaces, which, for example, offers the advantage that a very precise recess can be realized for attaching the locking element therein.

With the intention of better showing the characteristics of the invention, hereafter, as an example without any limitative character, several preferred embodiments are described, with reference to the accompanying figures, wherein:

BRIEF DESCRIPTION OF THE DRAWINGS

In FIGS. 1 to 3, a floor panel 1 is represented, which meets said first aspect of the invention.

The floor panel 1 is rectangular and oblong and consequently shows one pair of opposite short sides 2-3 and one pair of opposite long sides 4-5.

DETAILED DESCRIPTION OF VARIOUS EMBODIMENTS

Figure 2:
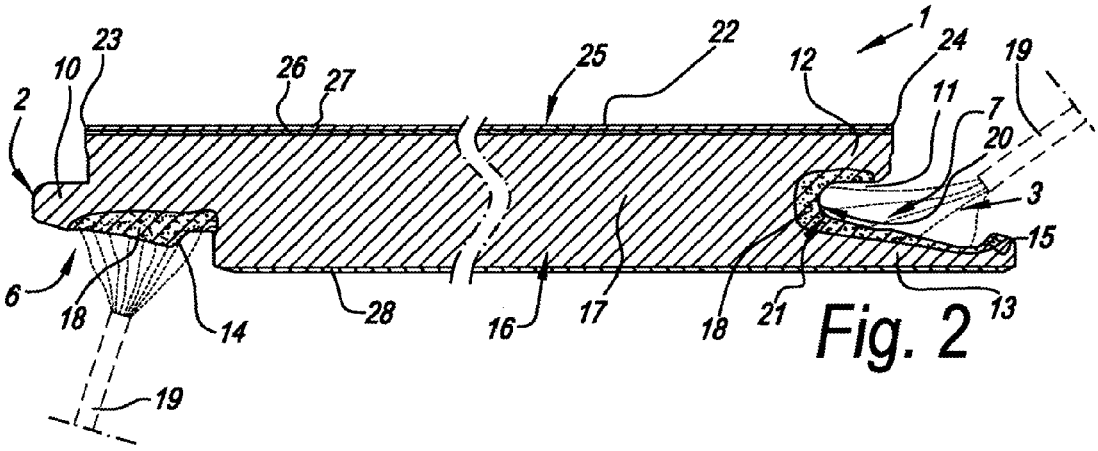
FIGS. 2 and 3, at a larger scale, represent cross-sections according to lines II-II and III-III, respectively, in FIG. 1.
Figure 3:
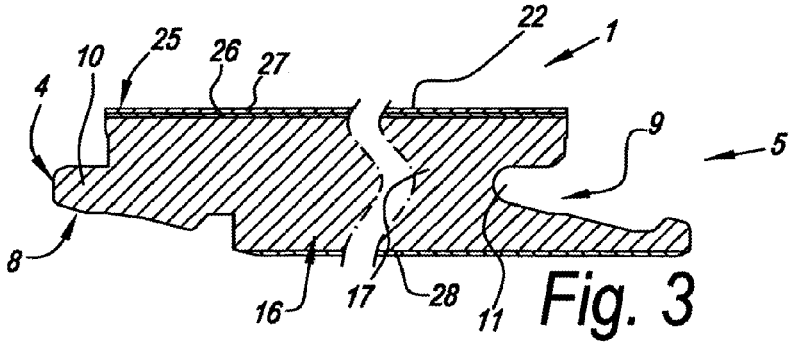

As is represented more detailed in FIGS. 2 and 3, the floor panel, at both pairs of opposite sides 2-3 and 4-5, comprises coupling parts, 6-7 and 8-9, respectively, which allow coupling the floor panel 1 with similar coupling panels, wherein these coupling parts are of the type which, in coupled condition, provides for a locking in vertical as well as in horizontal direction. Herein, these coupling parts 6-7-8-9 are made at least partially as profiles provided in the sides 2-3-4-5 of the floor panels 1. Preferably, these profiles extend continuously over the entire length of each respective side and are realized at least partially and preferably in a machining manner in the sides, for example, by means of one or more milling cycles.

In the represented example, the coupling parts, at the short sides 2-3 as well as at the long sides 4-5, substantially are made in a form such as known from WO 97/47834. Herein, they consist at two opposite sides of a tongue 10 and a groove 11, respectively. Herein, the groove 11 is bordered by an upper lip 12 at the top and by a lower lip 13 at the bottom, wherein in the represented example the lower lip 13 laterally extends further than the upper lip 12. Further, at the underside of the tongue 10 and the upper side of the lower lip 13, locking parts 14 and 15, respectively, are provided, which, in the coupled condition cooperate with each other in a known manner. In the coupled condition, the tongue 10 and groove 11 effect a vertical locking, whereas the locking parts 14-15, as they will engage behind each other in the coupled condition, ensure a locking in horizontal direction. The represented coupling parts allow that two of such floor panels can be engaged into each other at their sides, on choice, by means of a shifting or snap movement or by a turning movement, as known, amongst others, from said WO 97/47834.

It is clear that the coupling parts represented here form only an example and that other forms of coupling parts are possible. Also, the coupling parts of one pair of opposite sides must not be of the same shape as the coupling parts at the other pair of opposite sides.

As can be seen in FIGS. 2 and 3, the floor panel 1 comprises a core 16, or substrate, which consists of a wood fiberboard 17, formed of wood fibers which are bonded to each other by means of a binding agent and wherein this wood fiberboard 17 extends up to the sides 2-3-4-5 of the floor panel 1; and wherein at least the coupling part of at least one of the short sides 2-3 is formed at least partially from this wood fiberboard. More particularly, in this example even the coupling parts 6-7-8-9 of all sides 2-3-4-5 are realized at least partially, and in this case even entirely, in the wood fiberboard 17, as they are formed in there by machining, for example, by means of a milling process.

In accordance with the first aspect of the invention, the coupling part at least at one of the short sides, and in this case each coupling part 6-7 of both short sides 2-3, is provided with a reinforcing agent 18 provided at the location of the wood fibers, as is evident from FIG. 2, whereas the coupling parts 8-9 at the long sides 4-5 at least over the majority of their length are free from such reinforcing agent, as is evident from FIG. 3.

In order to meet the first aspect of the invention, the wood fiberboard 17 consists of MDF (Medium Density Fiberboard) and thus has an average density of not more than 800 kg/cubic meter. As explained in the introduction, such fiberboard is less expensive, however, due to the use of the reinforcing agent 18, it can still be guaranteed that the coupling parts which are loaded the most, namely, those at the short sides 2-3, are sufficiently strong, whereas the extra costs for the reinforcing agent remain very low, considering that it is not applied on the long sides.

Figure 1:
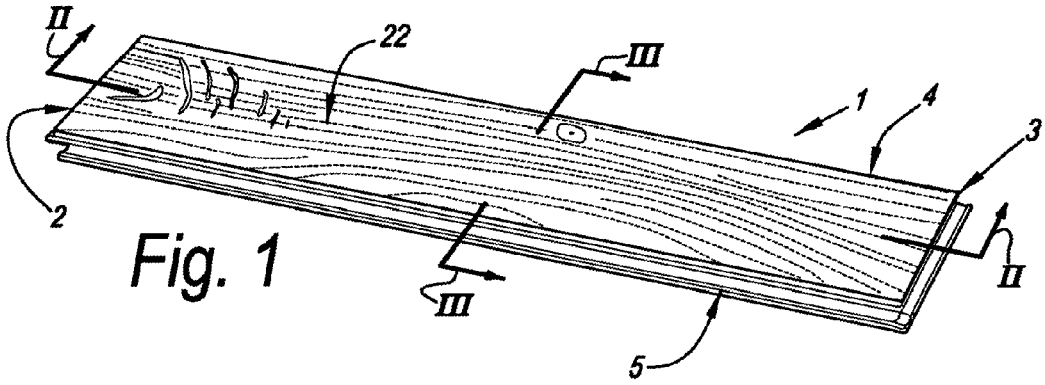
FIG. 1 in perspective represents a floor panel according to the invention.

It is noted that also when working in the lower densities of HDF, still useful economizations are possible, more particularly up to densities of 825 kg/cubic meter, as explained in the introduction in respect to the second aspect of the invention. Thus, this also means that, when in the embodiment of FIGS. 1 to 3, for the wood fiberboard 17 use is made of wood fiberboard having an average density of less than 825 kg/cubic meter and that this wood fiberboard, at least at the location of one or more of the coupling parts 6-7-8-9, is provided with a reinforcing agent provided via impregnation, the represented floor panel also meets the second aspect of the invention.

The reinforcing agent 18 is an agent which is provided in the surface of the coupling parts 6-7 by impregnation, such according to any technique. As schematically illustrated in FIG. 2, this can be realized, for example, by means of spraying nozzles 19. Other techniques which can be applied for this purpose are, amongst others, providing by means of spreading rollers or providing by means of vacuum heads, for example, from the Schiele company.

Of course, after applying, a forced drying and/or solidification can be provided, for example, by means of an air stream, by supplying heat or by radiation.

It is also not excluded to perform a treatment repeatedly or to work with two-component-products.

As aforementioned, the reinforcing agent 18 preferably consists of polyurethane, or an agent on the basis of polyurethane, however, also other agents which can effect an extra bond among the fibers, can be taken into account.

The reinforcing agent 18 can be provided at a coupling part on different locations, such in function of the location or locations where the manufacturer of the floor panels wants to realize an extra reinforcement. Herein, this may concern, for example, locations where the risk of damages is considered high, for example, where the risk that the wood fiberboard would split is largest or where there is a risk that portions would break off. However, it is clear that these locations also can be determined by means of tests by subjecting floor panels without reinforcing agent 18 to tests in order to detect the weakest places of the coupling parts and to apply the reinforcing agent at least there.

In the represented example of FIG. 2, reinforcing agent 18 is provided at approximately the complete surface of the groove 11. The most important locations, however, are:

at the laterally deepest-situated side or the deepest-situated portion 20 of the groove 11, in other words, the curve of the groove 11, as here with an undesired load there is a risk of tearing of the groove 11;

at the transition zone 21 between the innermost point of the groove 11 and the upper side of the lower lip, which is particularly useful in the case of a lower lip which laterally extends further than the upper lip, as in FIG. 2;

at the locking part 15 in order to reduce the risk of breaking off.

Thus, it is clear that according to not-represented variants on FIG. 2, not the entire interior side of the groove 11 shall be reinforced, but only certain portions thereof FIG. 2 also illustrates that at the other short side 2, the reinforcing agent 18 preferably is applied at least at the location of the locking part 14.

As represented in the example of FIG. 2, it is preferred that the reinforcing agent 18 is applied at a distance below the edge of the decorative side 22 of the floor panel 1 only, in other words, that the reinforcing agent 18 remains remote from the respective upper edges 23-24 of the floor panel 1.

As is represented in FIGS. 2 and 3 by way of example, the invention according to the first and second aspect is suited in particular for laminate floor panels which substantially consist of a core or substrate 16 of a one-piece wood fiberboard 17; a top layer 25 which is formed of one or more sheets impregnated with resin, for example, paper sheets, in this case, a printed and impregnated decor layer 26 as well as a so-called overlay 27, which are pressed on the wood fiberboard 17, and possibly a backing layer 28 at the underside of the core or the substrate. According to a not-represented alternative, the top layer 25 consists of a direct print, whether or not combined with other layers, wherein mostly first a number of primer layers are provided on the substrate, upon which then a motif is provided by printing and over which then at least one transparent protective layer, such as a transparent lacquer, is provided.

Figure 4:
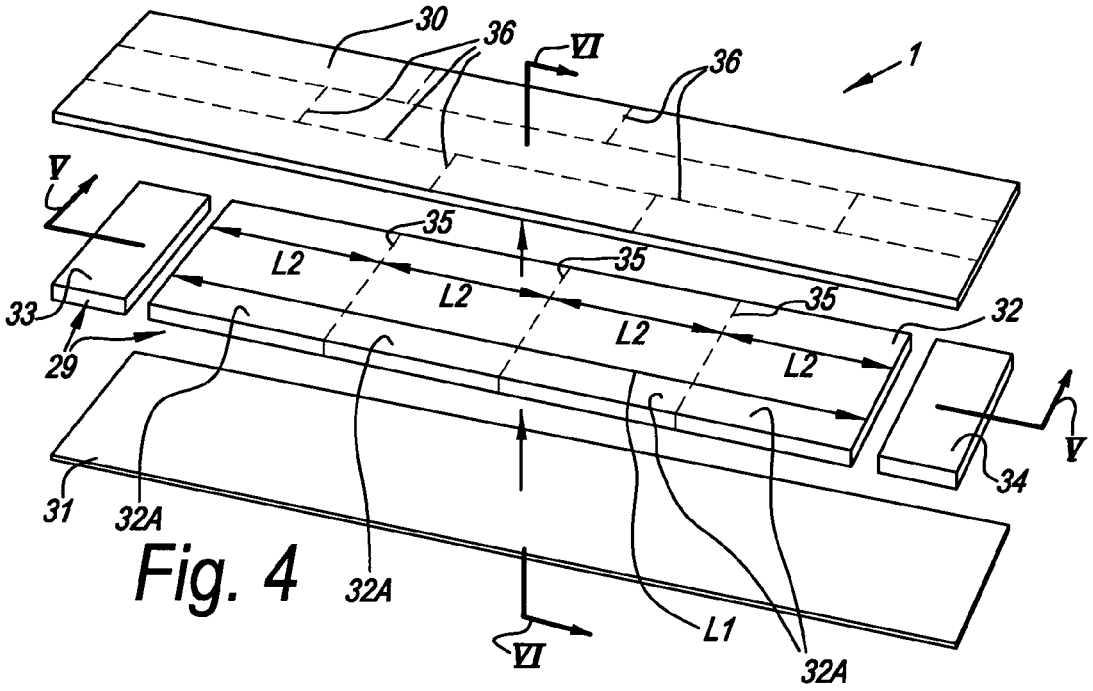
FIG. 4 in a perspective view, wherein the components are taken apart, represents another floor panel according to the invention, before the coupling parts have been attached to the sides.
Figure 5:
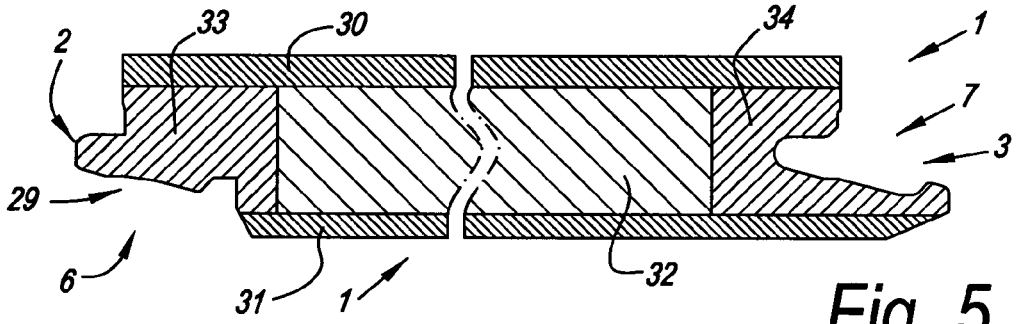
FIGS. 5 and 6, at a larger scale, represent cross-sections according to lines V-V and VI-VI, respectively, in FIG. 4, for the normal assembled condition.
Figure 6:
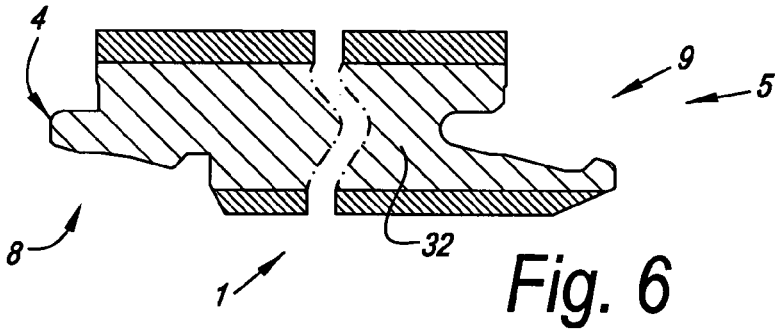

FIGS. 4 to 6 represent a floor panel 1, which meets the third independent aspect of the invention. In accordance with this third aspect, this floor panel 1 is constructed as a composed parquet panel, which comprises at least a substrate 29, a wood layer 30 attached thereon and a preferably wood-based backing layer 31 at the underside of the substrate 29. The floor panel 1 is rectangular, in this case, oblong, and thus comprises two pairs of opposite sides 2-3 and 4-5. Further, the floor panel 1 comprises, at both pairs of opposite sides 2-3 and 4-5, coupling parts 6-7 and 8-9, which allow that the floor panel 1 at all four sides can be coupled to similar floor panels. Herein, the coupling parts respectively are of a type which, in coupled condition, provides a locking in vertical as well as in horizontal direction.

Still in accordance with the third aspect of the invention, said substrate 29 is at least composed of a board-shaped material part 32 and a strip-shaped material part 33, 34, respectively, provided at least at one edge and in this case at both edges of the short sides 2-3, wherein at least one of said coupling parts, in this case thus the coupling parts 6-7 at the short sides, is realized in the respective strip-shaped material part and such strip-shaped material part 33-34, in respect to material composition, is made different in respect to said board-shaped material part 32.

In the embodiment represented in solid line, the substrate 29 comprises one continuous board-shaped material part 32, which extends over the entire floor panel 1, with the exception of the locations where a strip-shaped material part 33-34, as aforementioned, is present.

As represented by dashed lines 35 in FIG. 4, instead of one board-shaped material part 32 also a plurality of board-shaped material parts can be used, wherein the dashed lines 35 in the example then represent the edges of the respective board-shaped material parts 32A.

It is noted that the wood layer 30, which functions as a top layer, can consist of a one-piece layer as well as of a layer which is composed of several parts. In the case that it is composed of several parts, mostly separate parts or laths will be used, which together represent a multiple plank pattern, for example, as represented in FIG. 5 with dashed lines 36. It is clear that said wood layer at the upper side may or may not be further finished, for example, with products for pronouncing the wood decor and/or with products offering a protective layer, such as a varnish, oil or the like.

The invention according to the third aspect is particularly advantageous when each respective strip-shaped material part 33-34 consists of a material which is stronger than the material of which the board-shaped material part 32, the board-shaped material parts 32A, respectively, are consisting.

As explained in the introduction, it is preferred that in the case that the floor panel 1 is oblong, such board-shaped material part 32, 32A, respectively, at least in the direction extending parallel to the longitudinal direction of the floor panel 1, has a length of more than 20 cm and still better of more than 30 cm. In the represented example, this means that the overall length L1, as well as each of the lengths L2, preferably is larger than 20 cm and still better is larger than 30 cm.

FIGS. 4 and 6 also represent that the board-shaped material part 32, each of the board-shaped material parts 32A, respectively, extend, extends, respectively, in the crosswise direction of the floor panel 1 in one piece over the entire width of the floor panel 1.

Figure 7:
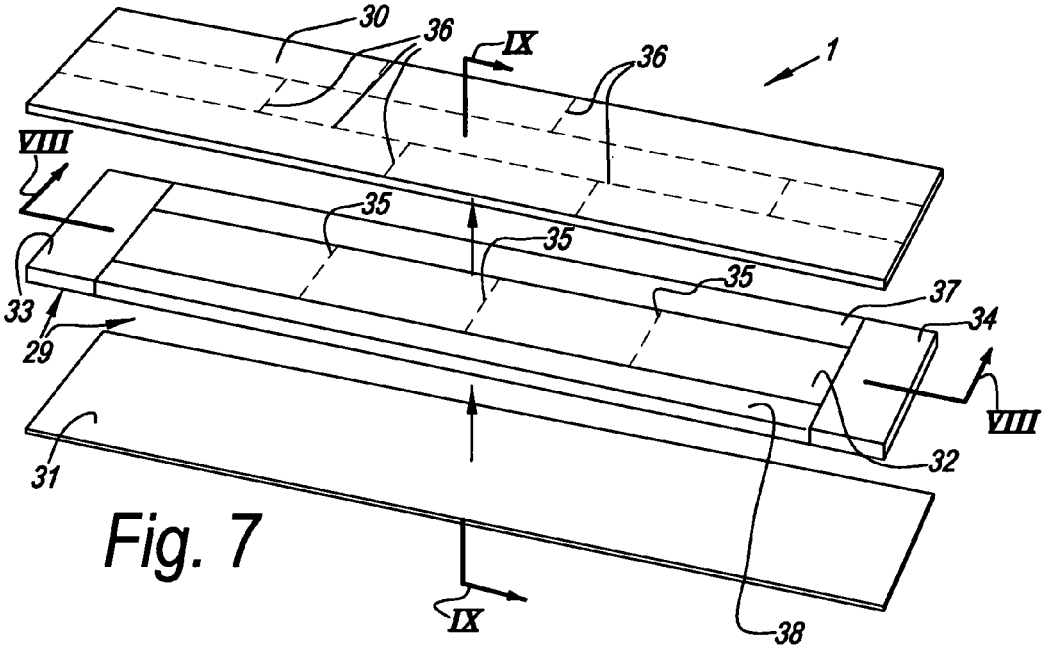
FIG. 7, in a perspective view in which the components have been taken apart, represents another floor panel according to the invention, before the coupling parts have been attached to the sides.
Figure 8:
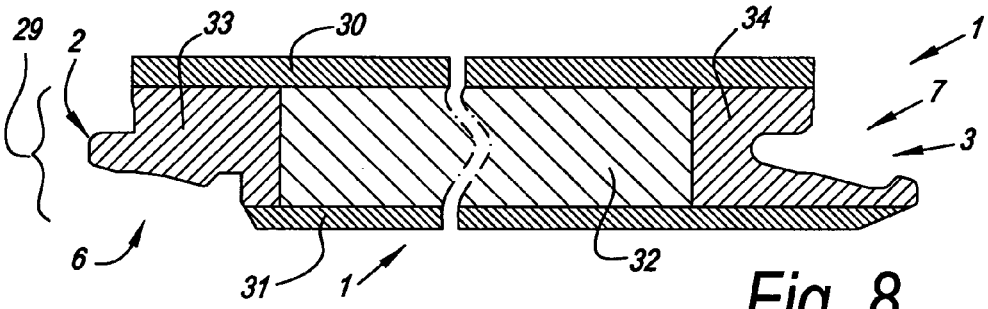
FIGS. 8 and 9, at a larger scale, represent cross-sections according to lines VIII-VIII and IX-IX, respectively, in FIG. 7, for the normal assembled condition.
Figure 9:
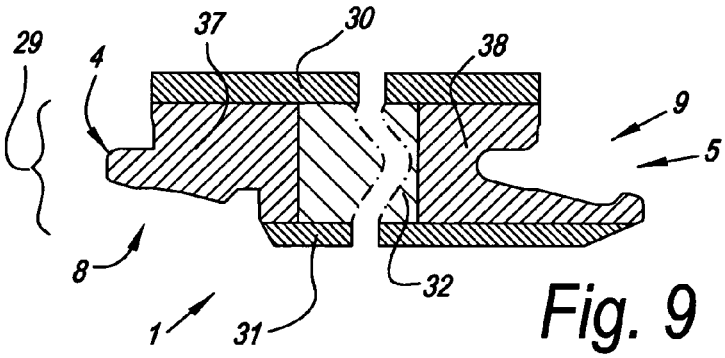

In FIGS. 7 to 9, a variant is represented wherein at all four sides thereof a strip-shaped material part 33-34 and 37-38, as aforementioned, is present, in which the respective coupling parts are realized. Here, material parts 33-34 at the short sides and material parts 37-38 at the long sides are concerned. In the represented example, the material parts 33-34 extend with their extremities up to the long sides, whereas the material parts 37-38 end against the material parts 33-34. It is clear that this may also be the case the other way round.

Said strip-shaped material parts 33-34 and/or 37-38 in the herein above-described embodiments of FIGS. 4 to 9, as well as in the also below described embodiment of FIGS. 10 to 11, preferably consist of HDF (High Density Fiberboard), thus with a density of 800 kg/cubic meter or higher, and still better higher than 840 kg/cubic meter.

As explained in the introduction, it is preferred with embodiments as represented in FIGS. 4 to 9 that the board-shaped material parts 32 or 32A as well as the strip-shaped material parts 33-34 consist of wood fiberboard, however, wherein for one or more and preferably all board-shaped material parts 32 or 32A, wood fiberboard of a lower density is applied than for the strip-shaped material parts 33-34. In the most preferred embodiment, the one or more board-shaped material parts 32-32A consist of MDF (Medium Density Fiberboard) and the strip-shaped material parts 33-34 consist of HDF (High Density Fiberboard).

According to a variant, one or more of the strip-shaped material parts shall consist of rubberwood, in view of the fact that also relatively strong coupling parts can be manufactured herein, whereas the board-shaped material parts then consist, for example, of MDF.

Figure 10:
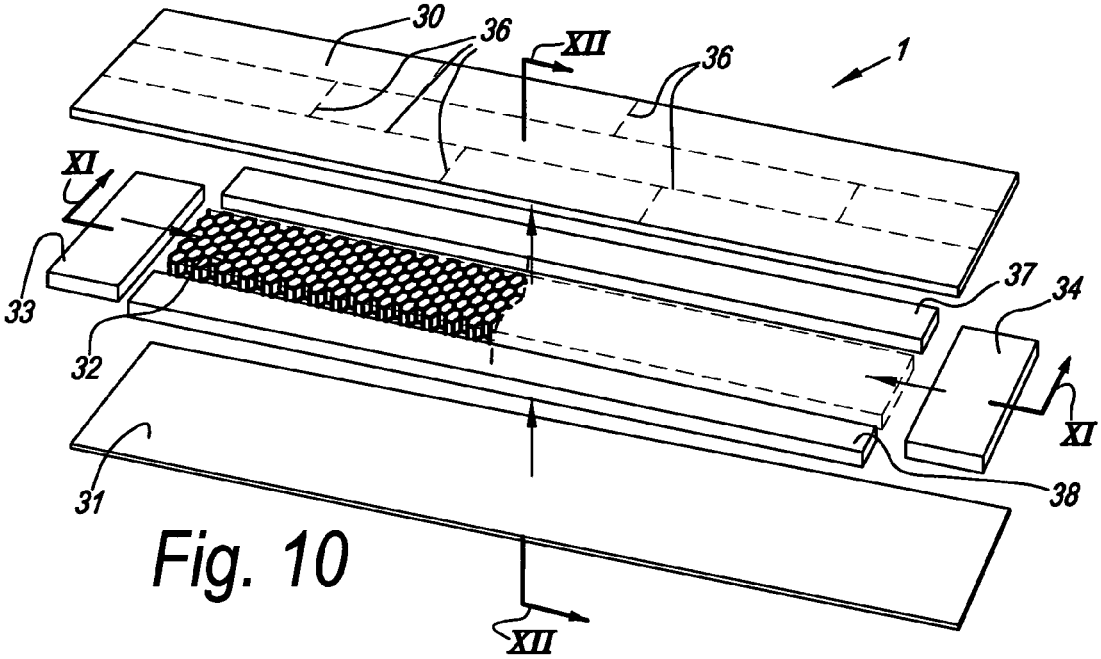
FIG. 10, in a perspective view in which the components have been taken apart, represents another floor panel according to the invention, before the coupling parts have been attached to the sides.
Figure 11:
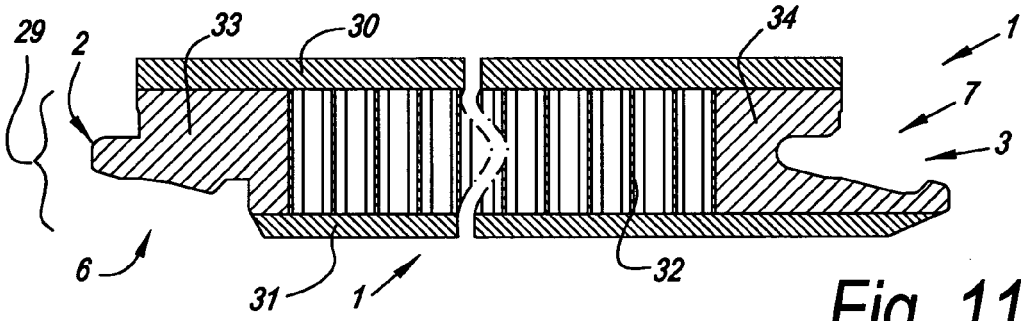
FIGS. 11 and 12, at a larger scale, represent cross-sections according to lines XI-XI and XII-XII, respectively, in FIG. 7, for the normal assembled condition.
Figure 12:
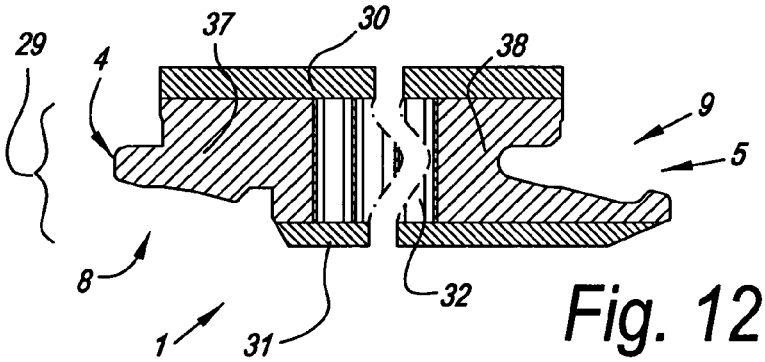

In FIGS. 10 to 12, a particular embodiment is represented, with a board-shaped material part 32, which is formed of a honeycomb board, for example, of cardboard.

It is clear that the strip-shaped and board-shaped material parts applied in the same floor panel preferably have the same thickness, such that, simply by positioning them next to each other, they are all situated with their upper sides in the same plane, as well as situated with all their undersides in the same other plane, which allows a simple gluing according to known techniques, which are applied when manufacturing "engineered wood".

It is noted that the composed parquet panels according to the invention each can be separately composed, glued and pressed, as well as, for example, be pressed with a plurality thereof at the same time as one whole, which then is sawed to form a plurality of individual floor panels, which then each as such have a structural construction of the type as represented in FIG. 4, 7 or 10.

It is noted that the coupling parts above-described herein and represented in the figures only form examples and that the invention is not restricted to the represented embodiments. For example, mutually differing forms of coupling parts can be applied at the first pair and second pair of opposite sides, which possibly require a different coupling technique. Also, according to the invention coupling parts may be applied, which are only partially realized in the core 16 or the material of the strip-shaped material parts. Examples thereof are coupling parts which are partially realized from a synthetic material strip, for example, as described in DE 20 2008 008 597.

However, the invention shows its advantages in particular when on all sides coupling parts are applied which are removed from the substrate in one piece, such in order to exclude all additional costs of separate parts.

According to a deviating variant of the invention, the floor panels, at one pair of opposite edges, shall be provided with coupling parts which, when coupling two of such panels, exclusively provide for a horizontal locking, in other words, coupling parts which are of the so-called drop-in type.

Hereafter, with reference to FIGS. 13 to 18, some embodiments of floor panels 1 are described, which are realized in accordance with the fourth aspect of the invention. The examples of FIGS. 13 to 18 represent cross-sections in the longitudinal direction of an oblong floor panel 1.

Figures 13, 14, 15:
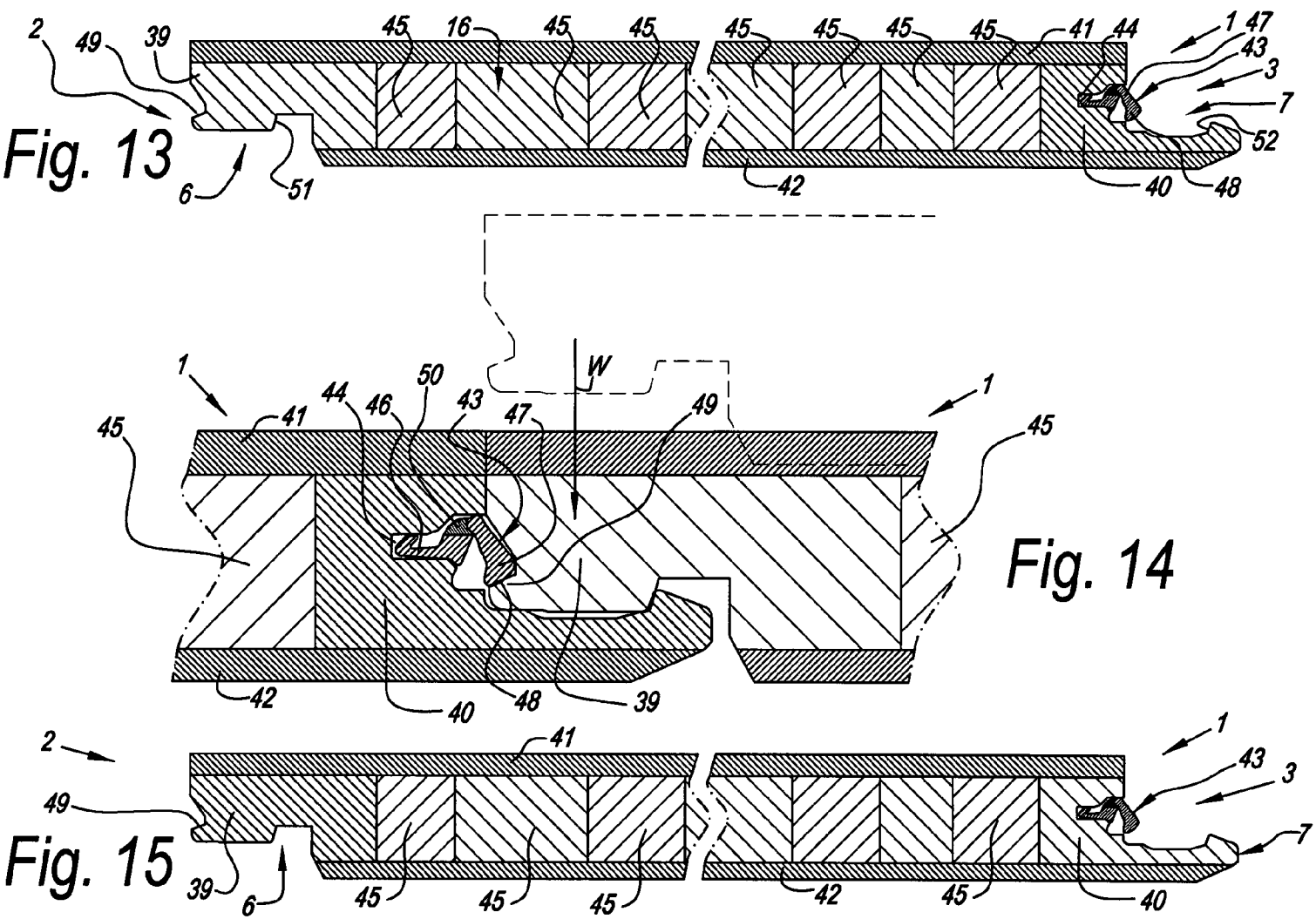
FIG. 13 in cross-section represents a floor panel according to the fourth aspect of the invention.
FIG. 14 represents two floor panels, such as those of FIG. 13, in coupled condition.
FIGS. 15 to 18, according to cross-sections analogous to that of FIG. 13, represent other different variants which apply the fourth aspect of the invention.

As represented in FIG. 13, this herein relates to a floor panel 1 for forming a floor covering, which comprises at least one pair of two opposite sides 2-3; wherein this floor panel 1, at this pair of opposite sides 2-3, comprises coupling parts 6-7, which allow to couple the floor panel 1 with similar floor panels; wherein these coupling parts 6-7, in coupled condition, provide a locking in vertical as well as in horizontal direction; wherein this floor panel 1 comprises a core 16, which consists of at least two core material parts 39-40, which are provided as a sandwich structure between an upper layer 41 and a bottom layer 42 and which respectively extend up to one of said two sides 2-3; and wherein the coupling parts, at least at one of said sides, comprise a locking element 43 in the form of an insert mounted in the core material part 40 present there, which locking element 43 is of the type which, in the coupled condition of two of such floor panels 1, effects a locking in vertical direction. This floor panel 1 further is characterized in that the aforementioned two core material parts 39-40, which are situated at the sides 2 and 3, consist of a different basic material or of a basic material with different properties.

Said insert is provided in a recess 44, which for this purpose is provided in the core material part 40.

In the example of FIG. 13, the core 16, apart from said two core material parts 39-40 situated at said sides 2-3, also is constructed of a plurality of intermediate core material parts 45. As represented, at least the core material parts 39-40 situated at the sides 2-3 are performed as strip-shaped elements, which in the figures thus are in a transverse cross-section. In the example of FIG. 13, moreover also the intermediate core material parts 45 are realized as strip-shaped elements. All these strip-shaped elements preferably extend over the entire width of the floor panels 1, analogous to, for example, the strip-shaped material parts of FIG. 4.

In the example of FIG. 13, the basic material of the core material part 40 consists, for example, of MDF (Medium Density Fiberboard) or HDF (High Density Fiberboard), as such material is easy to process and smooth and accurate surfaces can be formed therein, for example, by means of one or more milling treatments. As a consequence thereof, the recess 44 for the locking element 43 can be realized in a very accurate manner, such that it is guaranteed that the insert, after mounting, is sitting at the right place. The core material part 39 situated at the other side, however, is realized from the same basic material as the intermediate core material parts 45, for example, of softwood, which, on the one hand, is cheaper in respect to material costs and also is cheaper in the production of the floor panels, as no special sorting step must be provided for applying another material at the side 2, too.

In the example of FIG. 13, the floor panel is constructed as a composed parquet panel, with a wooden upper layer 41 and a bottom layer 42, which latter preferably also consists of wood. The wooden upper layer 41, for example, consists of hardwood and may or may not be composed of a plurality of parts, whereas the bottom layer 42 preferably consists of a cheaper wood species, such as softwood.

It is noted that in the represented example, said locking element 43 exclusively provides for a vertical locking, whereas all remaining parts, which provide a locking, substantially are realized in one piece from said core material parts 39 and 40. This offers the advantage that the locking element 43, seen in cross-section, can be kept relatively small in extent, as a consequence of which the material costs thereof remain low.

More particularly, the locking element 43 herein consists of a locking strip, which is provided in the recess 44. Preferably, the locking strip consists of synthetic material; however, the use of other materials is not excluded. Further, it is preferred that the strip extends over the entire or almost entire length of the respective side 3. It is also preferred that the strip has a continuous cross-section over its entire length.

In the represented example of FIGS. 13 and 14, also coupling parts 6-7 are applied, of the type which allows to couple two of such floor panels 1 by means of a downward movement W of one floor panel 1 in respect to the other, as indicated in FIG. 14, wherein the locking strip, seen in cross-section, consists at least of an attachment portion 46 and a blocking portion 47, which is movable in respect to the attachment portion 46, which blocking portion with one extremity 48 can cooperate in a locking manner with a locking edge 49, which is situated on another floor panel to be coupled. In the example, a locking strip, which is known as such, is used for the locking element 43, wherein, as described in WO 2009/066153, a flexible hinge portion 50 of a more flexible material is applied between the attachment portion 46 and the blocking portion 47, and wherein these three component parts preferably are formed as a single whole by means of extrusion.

It is clear that the locking in horizontal direction is obtained by the locking parts indicated by reference numbers 51 and 52, as well by the floor panels coming into contact in the proximity of their upper edges. This contact preferably is situated at the height of the upper layer 41.

In FIG. 15, a variant is represented, wherein the core material part 40 and the core material parts 45 consist of the same basic material, whereas the core material part 39 is made of another basic material. This is of importance, for example, if one wants to render the coupling part 6 extra strong.

Figure 16:
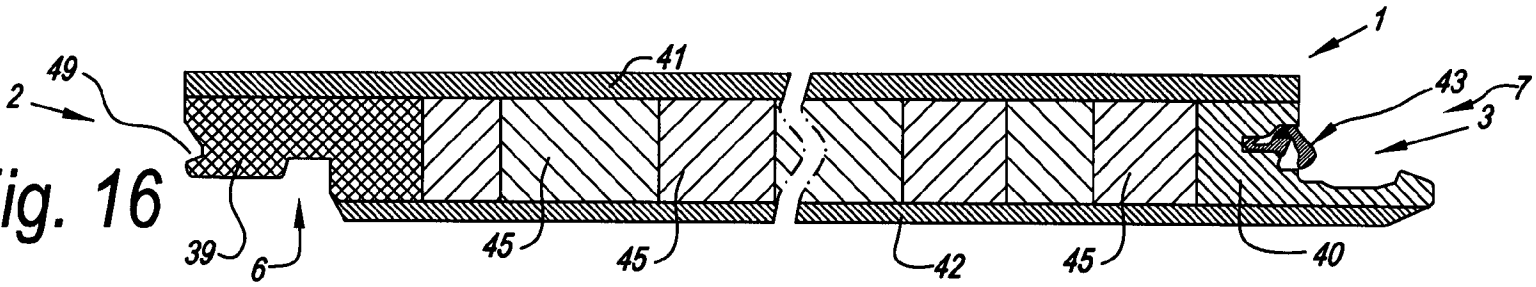

In FIG. 16, an embodiment is represented, wherein three different basic materials are applied, for the core material parts 39, 40 and 45, respectively. For example, the core material part 40 consists of MDF or HDF, the core material part 39 consists of a cheaper material, however, still having a good form stability, such as, for example, rubberwood, whereas the core material parts 45 consist of softwood.

Figure 17:
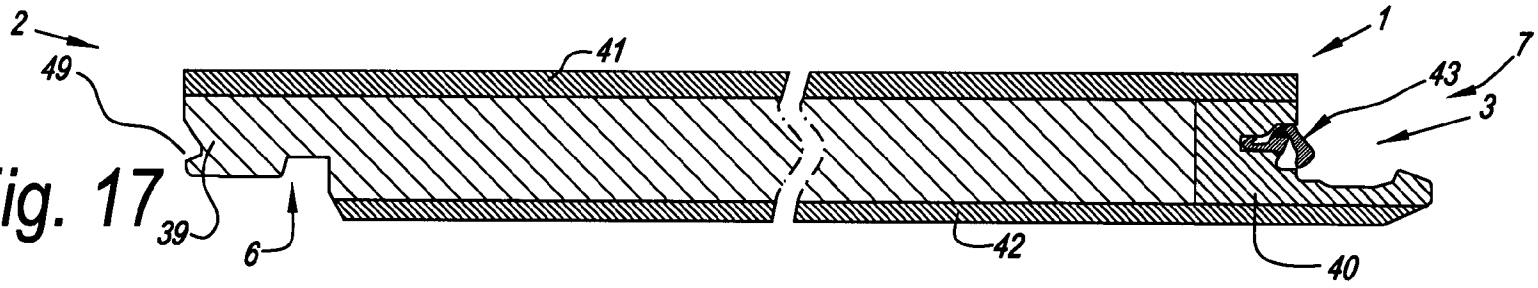
Figure 18:
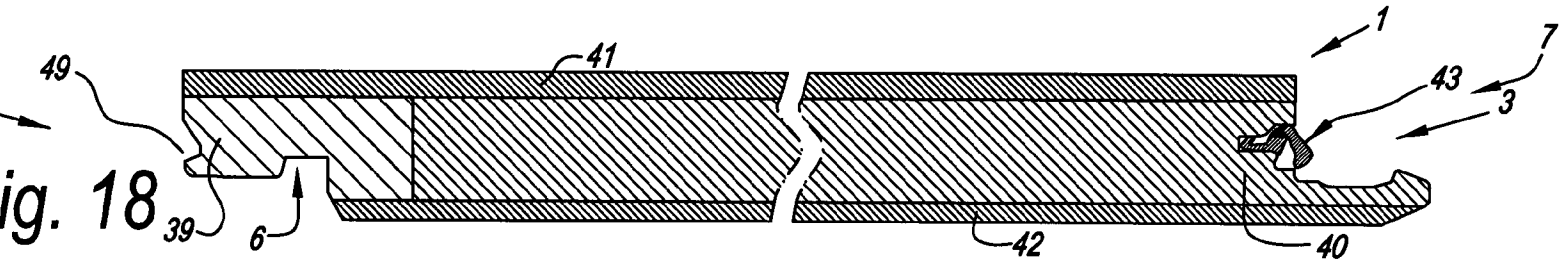

It is noted that it is not excluded to not apply any intermediate core material parts 45, however, as required by the fourth aspect, indeed to apply core material parts 39 and 40, which consist of a different basic material. In FIGS. 17 and 18, two examples thereof are represented. The selection of the material may be performed by the manufacturer in function of the requirements. It is clear that these requirements may differ in function of the desired effect, as well as in function of the shape and dimensions of the finally applied coupling parts. Certain coupling parts in fact require a stronger material than others in order to be able to withstand the forces usually exerted thereon.

For example, in the embodiment of FIG. 17, MDF, which is cheaper than HDF, can be applied for the core material part 39, whereas for the core material part 40, HDF is applied, which is more stable for attaching the locking element 43 therein. In the embodiment of FIG. 18, for example, MDF or HDF can be used for the core material part 40, whereas for the core material part 39, use is made of synthetic material.

It is noted that the invention according to the fourth aspect is not limited to floor panels with the herein above-described upper layer and bottom layer. In principle, each of these layers can be of any kind and material, such layer may or may not consist of a plurality of parts, or such layer as such can be composed of a plurality of material layers. Also, such layers may be provided with a different finish. For example, one or more protective layers can be provided on the upper side of the upper layer 41, in which possibly impressions will be provided.

The various component parts preferably are kept together to form a single panel in a classical manner by means of gluing. The profiles of the coupling parts 6-7, including the recess 44, preferably are provided at the sides 2-3 only after composing such floor panel, for example, by means of a milling treatment.

The present invention is in no way limited to the embodiments described by way of example and represented in the figures; on the contrary may such floor panel be realized in various forms and dimensions, without leaving the scope of the invention.

The invention claimed is:

1. A floor panel for forming a floor covering, wherein the floor panel comprises at least one pair of two opposite sides;

wherein the floor panel, at said pair of opposite sides, comprises coupling parts configured to couple the floor panel to similar floor panels;

wherein the coupling parts, in a coupled condition, are locked with corresponding similar coupling parts of said similar floor panels in a vertical direction and in a horizontal direction;

wherein the floor panel has a core including at least two core material parts, the core is provided as a sandwich structure between an upper layer and a bottom layer, said core extending from one of said opposite sides to the other of said opposite sides so the upper and bottom layers are maintained spaced apart by the at least two core material parts along a longitudinal length of the panel, and said at least two core material parts each extend to a respective one of said at least two opposite sides, wherein each of the at least two core material parts is located adjacently below said upper layer and adjacently above said bottom layer;

wherein at least one of the coupling parts comprises a locking element configured as an insert, the insert being mounted in one of said at least two core material parts, wherein the locking element, in the coupled condition, provides a locking in the vertical direction between said floor panel and one of said similar floor panels; and wherein said at least two core material parts are formed of different materials or materials having different properties.

2. The floor panel of claim 1, wherein the floor panel is rectangular and oblong and wherein the at least one pair of two opposite sides comprises one pair of opposite short sides and one pair of opposite long sides, wherein said core material parts are situated at the opposite short sides.

3. The floor panel of claim 1, wherein said locking element is configured to lock said floor panel with one of said similar floor panels in said vertical direction, wherein portions of the coupling parts not including the locking element are formed substantially in one piece with said at least two core material parts.

4. The floor panel of claim 1, wherein said locking element includes a locking strip, the locking strip being provided at a recess in the core.

5. The floor panel of claim 4, wherein the coupling parts are arranged to allow said floor panel to be coupled to said one of said similar floor panels by a movement in the vertical direction, said one of said similar floor panels being adjacent to said floor panel, and wherein the locking strip includes an attachment portion and a blocking portion movable with respect to the attachment portion, the blocking portion cooperating with a locking edge of said one of said similar floor panels.

6. The floor panel of claim 1, wherein the floor panel is a parquet panel, wherein the upper and bottom layers each comprise a wood material.

7. The floor panel of claim 1, wherein said core is composed of the at least two core material parts situated at said two opposite sides, and one or more intermediate core material parts, each of the core material parts situated at said two opposite sides being strip-shaped material parts.

8. The floor panel of claim 7, wherein the one or more intermediate core material parts comprises additional strip-shaped material parts.

9. The floor panel of claim 7, wherein one of the core material parts situated at said two opposite sides and the one or more intermediate core material parts consist of the same material.

10. The floor panel of claim 1, wherein only one of the core material parts situated at said two opposite sides is provided with said locking element and said one of the core material parts consists of wood fiberboard.

11. The floor panel of claim 10, wherein the wood fiberboard is selected from the group consisting MDF and HDF.

12. The floor panel of claim 1, wherein the at least two core material parts are adjacent to one another and define the core.

* * * * *